US010715914B2

(12) United States Patent
Tawada

(10) Patent No.: US 10,715,914 B2
(45) Date of Patent: Jul. 14, 2020

(54) SIGNAL PROCESSING APPARATUS, SIGNAL PROCESSING METHOD, AND STORAGE MEDIUM

(71) Applicant: CANON KABUSHIKI KAISHA, Tokyo (JP)

(72) Inventor: Noriaki Tawada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/256,877

(22) Filed: Jan. 24, 2019

(65) Prior Publication Data

US 2019/0238980 A1 Aug. 1, 2019

(30) Foreign Application Priority Data

Jan. 31, 2018 (JP) ..... 2018-015118

(51) Int. Cl.

| | |
|---|---|
| ***H04R 3/12*** | (2006.01) |
| ***H04R 5/02*** | (2006.01) |
| ***H04R 5/04*** | (2006.01) |
| ***H04S 7/00*** | (2006.01) |

(52) U.S. Cl.

CPC ..... *H04R 3/12* (2013.01); *H04R 5/02* (2013.01); *H04R 5/04* (2013.01); *H04S 7/302* (2013.01); *H04S 7/303* (2013.01); *H04R 2430/01* (2013.01); *H04S 2400/15* (2013.01); *H04S 2420/01* (2013.01)

(58) Field of Classification Search

CPC ... H04R 3/12; H04R 5/02; H04R 5/04; H04R 2430/01; H04S 7/303

See application file for complete search history.

(56) References Cited

U.S. PATENT DOCUMENTS 4,817,153 A * 3/1989 Fernandez ..... H04R 1/08 381/111
7,116,788 B1 * 10/2006 Chen ..... H04S 3/004 381/17

FOREIGN PATENT DOCUMENTS

JP 5655378 B2 1/2015

OTHER PUBLICATIONS

English machine translation of JP 5655378 (Ono et al.; Sound image control device and program; published Jan. 2015).*
English human translation of JP 2011-254195 (Ono et al., Sound Image Control Device and Program, published Dec. 2011).*

* cited by examiner

*Primary Examiner* — Mark Fischer
(74) *Attorney, Agent, or Firm* — Canon U.S.A., Inc. IP Division

(57) ABSTRACT

A signal processing apparatus that generates a reproducing signal from an input audio signal includes an information acquisition unit that acquires information about an arrangement of a plurality of speakers used for reproduction of a sound that is based on the reproducing signal, a specifying unit that specifies a target range for localization of a sound corresponding to the input audio signal, a setting unit that sets a plurality of virtual sound sources used for localization of a sound based on the specified target range based on the acquired information about the arrangement of the plurality of speakers, and a generation unit that generates the reproducing signal by processing the input audio signal based on setting of the plurality of virtual sound sources.

16 Claims, 8 Drawing Sheets

SIGNAL PROCESSING APPARATUS, SIGNAL PROCESSING METHOD, AND STORAGE MEDIUM

BACKGROUND

Field

Aspects of the present disclosure generally relate to a technique to generate an audio signal that is reproduced by a plurality of speakers (loudspeakers).

Description of the Related Art

There is a technique called "panning" that, when reproducing sound using a plurality of speakers, controls the volume or phase of a sound that is output from each speaker to localize a specific sound in a designated direction. This technique enables a listener to perceive a specific sound in such a way as to hear from the designated direction. Japanese Patent No. 5,655,378 discusses a technique in which, in a case where a target range to which to localize sound has been determined, a plurality of virtual sound sources is set within the target range, so that an audio signal for reproducing a sound that enables perceiving a spatial broadening corresponding to the target range can be generated.

However, in the case of using the technique discussed in Japanese Patent No. 5,655,378, depending on a reproduction environment for an audio signal to be generated, there is a possibility that it is impossible to appropriately control the broadening of a sound to be perceived by the listener. For example, in a speaker configuration of, for example, 5.1 channel surround, the number of rear speakers is smaller than the number of front speakers, so that the arrangement of speakers is not isotropic. In a case where a sound that is based on an audio signal generated in the method discussed in Japanese Patent No. 5,655,378 is reproduced using speakers of such an arrangement, there is a possibility that the broadening of a sound to be perceived by the listener might be unconsciously changed due to a direction in which to localize sound.

SUMMARY

According to an aspect of the present disclosure, a signal processing apparatus that generates a reproducing signal from an input audio signal includes an information acquisition unit configured to acquire information about an arrangement of a plurality of speakers used for reproduction of a sound that is based on the reproducing signal, a specifying unit configured to specify a target range for localization of a sound corresponding to the input audio signal, a setting unit configured to set a plurality of virtual sound sources used for localization of a sound based on the specified target range, based on the acquired information about the arrangement of the plurality of speakers, and a generation unit configured to generate the reproducing signal by processing the input audio signal based on setting of the plurality of virtual sound sources.

Further features will become apparent from the following description of exemplary embodiments with reference to the attached drawings.

DESCRIPTION OF THE EMBODIMENTS

Figure 1:
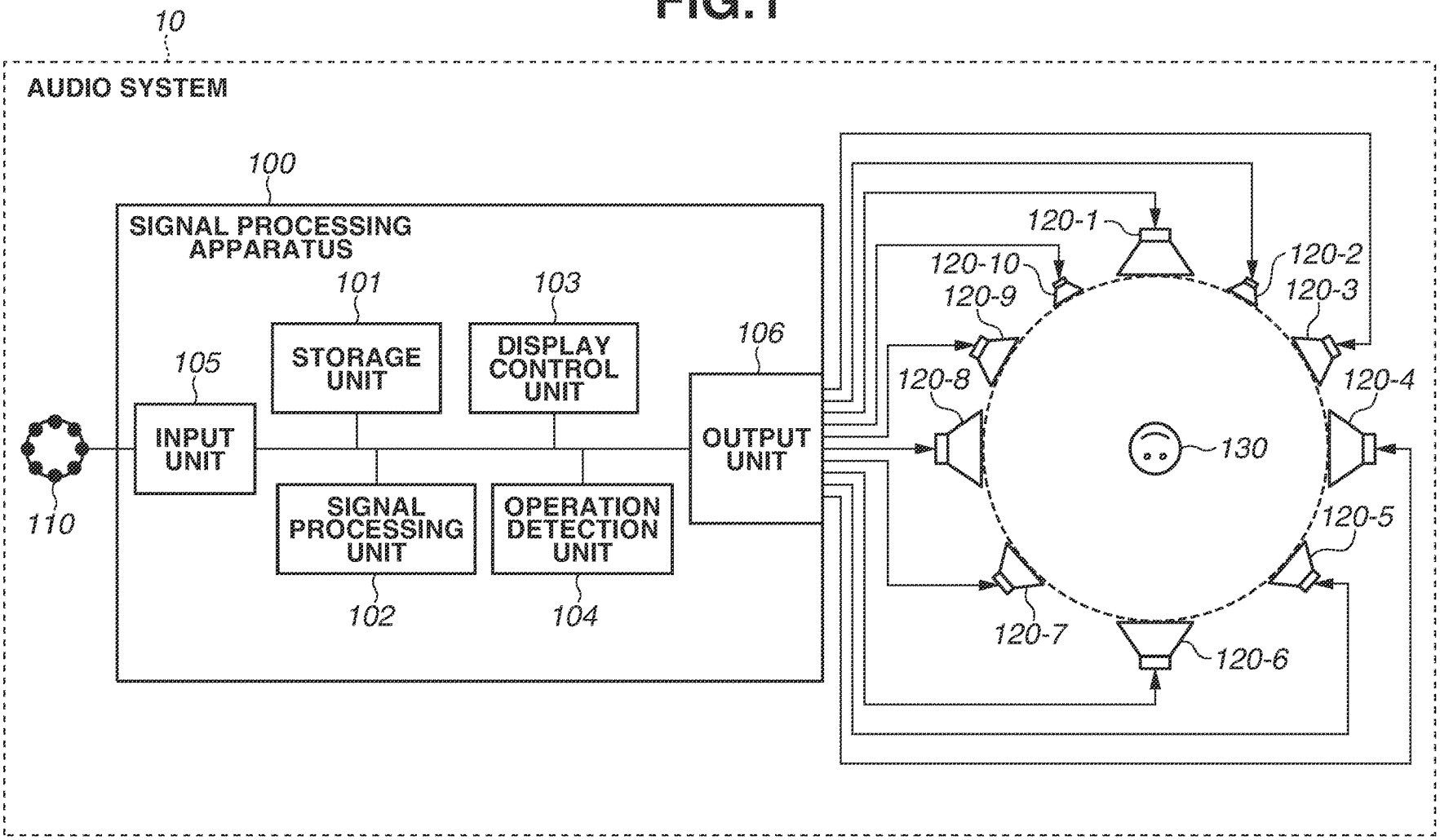
FIG. 1 is a block diagram illustrating a configuration of a signal processing system according to an exemplary embodiment.

Various exemplary embodiments, features, and aspects will be described in detail below with reference to the drawings. The following exemplary embodiments are not intended to be limiting, and not all of the combinations of features described in the exemplary embodiments are essential for solutions in the present disclosure. The same constituent elements are assigned the respective same reference characters for description purposes.

<System Configuration>

FIG. 1 is a block diagram illustrating a configuration example of an audio system 10 according to an exemplary embodiment. The audio system 10 includes a microphone 110, a signal processing apparatus 100, and ten speakers (speaker 120-1 to speaker 120-10). Hereinafter, unless specifically distinguished, speaker 120-1 to speaker 120-10 are referred to as "speaker 120" or "speakers 120". The microphone 110 is installed in the vicinity of a predetermined sound pickup target area and picks up sound in the sound pickup target area. Then, the microphone 110 outputs an audio signal (picked-up sound signal) obtained by sound pickup to the signal processing apparatus 100 connected to the microphone 110.

The predetermined sound pickup target area, in which sound is picked up by the microphone 110, includes, for example, an athletic field or a concert venue. Specifically, the microphone 110 is installed near spectator stands of the athletic field as a sound pickup target area and picks up sounds emitted by a plurality of persons situated in the spectator stands. However, the sound to be picked up by the microphone 110 is not limited to a sound such as a voice emitted by a person, but can be a sound emitted by, for example, a musical instrument or a speaker. The microphone 110 is not limited to a microphone that picks up sound emitted by a plurality of sound sources, but can pick up a sound emitted by a single sound source. The installation location of the microphone 110 or the sound pickup target area is not limited to the above-mentioned one. The microphone 110 can be configured with a single microphone unit or can be a microphone array including a plurality of microphone units. In the audio system 10, a plurality of microphones 110 can be installed in a plurality of locations and, then, each microphone 110 can output a picked-up sound signal to the signal processing apparatus 100.

Figure 8:
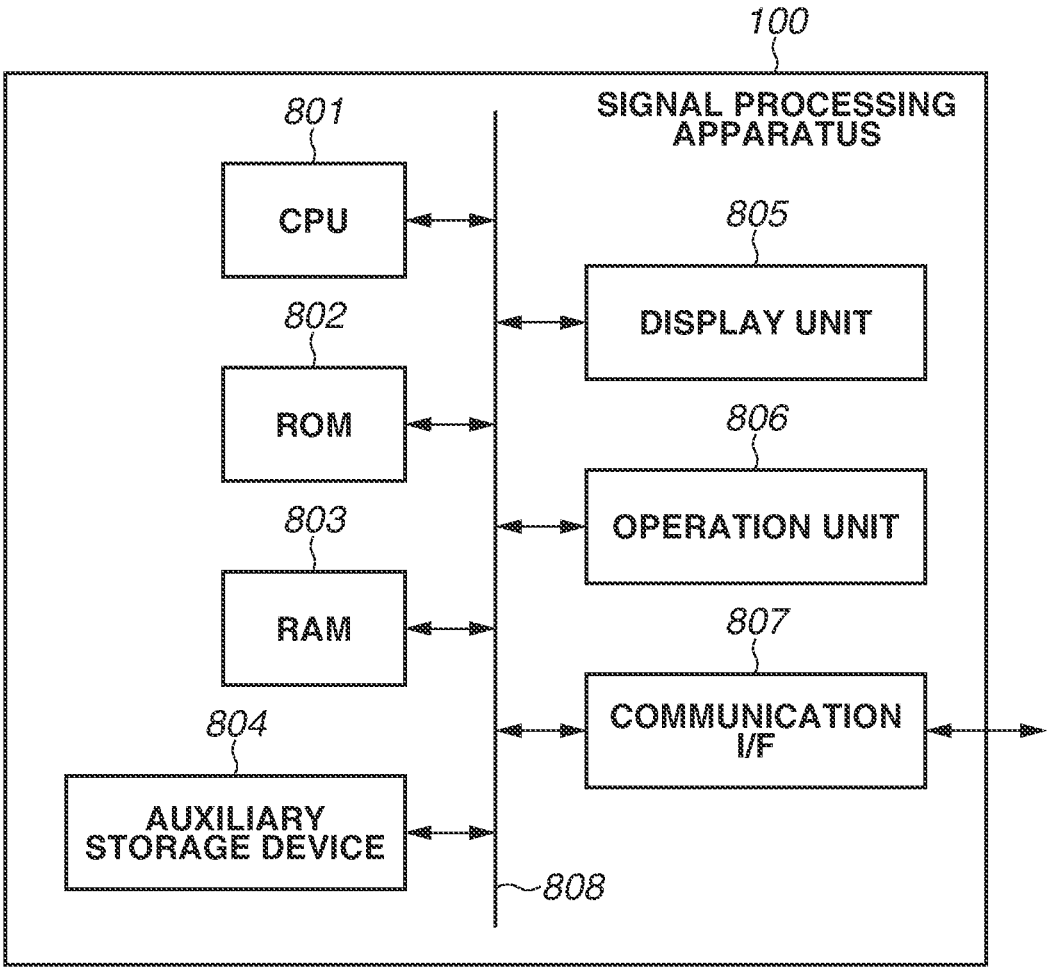
FIG. 8 is a block diagram illustrating a hardware configuration of the signal processing apparatus according to the exemplary embodiment.

The signal processing apparatus 100 generates an audio signal for reproduction (a reproducing signal) by performing signal processing on the picked-up sound signal serving as an input audio signal input from the microphone 110, and outputs the generated reproducing signal to each speaker 120. A hardware configuration of the signal processing apparatus 100 is described with reference to FIG. 8. The signal processing apparatus 100 includes a central processing unit (CPU) 801, a read-only memory (ROM) 802, a random access memory (RAM) 803, an auxiliary storage device 804, a display unit 805, an operation unit 806, a communication interface (I/F) 807, and a bus 808.

The CPU 801 controls the entire signal processing apparatus 100 using computer programs and data stored in the ROM 802 and the RAM 803. The signal processing apparatus 100 can include one or a plurality of pieces of dedicated hardware different from the CPU 801, and at least some of processing operations to be performed by the CPU 801 can be performed by the dedicated hardware. Examples of the dedicated hardware include an application specific integrated circuit (ASIC), a field-programmable gate array (FPGA), and a digital signal processor (DSP). The ROM 802 stores programs and parameters that are not required to be subject to change. The RAM 803 temporarily stores, for example, programs and data supplied from the auxiliary storage device 804 and data supplied from the outside via the communication I/F 807. The auxiliary storage device 804 is configured with, for example, a hard disk drive, and stores various types of content data, such as an audio signal.

The display unit 805 is configured with, for example, a liquid crystal display or light-emitting diode (LED) display, and displays, for example, a graphical user interface (GUI) used for the user to operate the signal processing apparatus 100. The operation unit 806 is configured with, for example, a keyboard, a mouse, or a touch panel, and receives an operation performed by the user to input various instructions to the CPU 801. The communication I/F 807 is used for communications with external apparatuses, such as the microphone 110 and the speaker 120. For example, in a case where the signal processing apparatus 100 is connected to an external apparatus by wired connection, a cable for communication is connected to the communication I/F 807. In a case where the signal processing apparatus 100 has a function to perform wireless communication with an external apparatus, the communication I/F 807 is equipped with an antenna. The bus 808 connects various units of the signal processing apparatus 100 and is used to transmit information therebetween.

As illustrated in FIG. 1, the signal processing apparatus 100 includes, as functional constituent elements thereof, a storage unit 101, a signal processing unit 102, a display control unit 103, an operation detection unit 104, an input unit 105, and an output unit 106. These functional units are implemented by the respective hardware constituent elements illustrated in FIG. 8. The storage unit 101 stores various pieces of data, such as a picked-up sound signal, setting information about signal processing, and the location of speakers 120. The signal processing unit 102 performs various processing operations on a picked-up sound signal to generate a reproducing signal that is used to reproduce sound by the speakers 120. The display control unit 103 causes the display unit 805 to display various pieces of information. The operation detection unit 104 detects an operation that has been input via the operation unit 806. The input unit 105 receives inputs from the microphone 110 to acquire a picked-up sound signal that is based on sound pickup performed by the microphone 110. The output unit 106 outputs a generated reproducing signal having a plurality of channels to a plurality of speakers 120.

The speaker 120 reproduces a reproducing signal output from the signal processing apparatus 100. Specifically, respective different channels of reproducing signals are input to speaker 120-1 to speaker 120-10, and each speaker 120 reproduces the input reproducing signal. With this, the audio system 10 functions as a surround audio system that lets a user who uses speaker 120 (a listener 130) to listen to sound. While FIG. 1 illustrates a case where the audio system 10 includes ten speakers 120, the number of speakers 120 is not limited to this, and only a plurality of speakers 120 needs to be included in the audio system 10. A plurality of speakers 120 can be mounted on headphones or earphones wearable by the listener 130.

While FIG. 1 illustrates an example in which the microphone 110 and the signal processing apparatus 100 are directly interconnected and the signal processing apparatus 100 and the speaker 120 are directly interconnected, the present exemplary embodiment is not limited to this. For example, a picked-up sound signal that is based on sound pickup performed by the microphone 110 can be stored in a storage device (not illustrated) connectable to the signal processing apparatus 100, and the signal processing apparatus 100 can acquire the picked-up sound signal from the storage device. The signal processing apparatus 100, for example, can output a reproducing signal to an audio apparatus (not illustrated) connectable to the signal processing apparatus 100, and the audio apparatus can perform processing on the reproducing signal and output the processed reproducing signal to the speaker 120. The signal processing apparatus 100 can acquire, instead of the picked-up sound signal that is based on sound pickup performed by the microphone 110, an audio signal generated by a computer as an input audio signal.

<Localization of Sound to Target Range>

Next, a purpose and an outline of signal processing according to the exemplary embodiment are described. In generating a reproducing signal that is reproduced by a plurality of speakers 120, the signal processing apparatus 100 controls the volume or phase of a sound that is output from each speaker, thus performing panning, which localizes a specific sound that is based on a picked-up sound signal to a designated position or direction. Localizing a specific sound to a designated position or direction is causing the listener 130 to perceive the specific sound in such a way as to hear from the designated position or direction. In particular, in the audio system 10 according to the present exemplary embodiment, a target range to which to localize sound is designated, and signal processing for localizing a sound the broadening of which corresponding to the size of the designated target range can be felt is performed.

Figure 3:
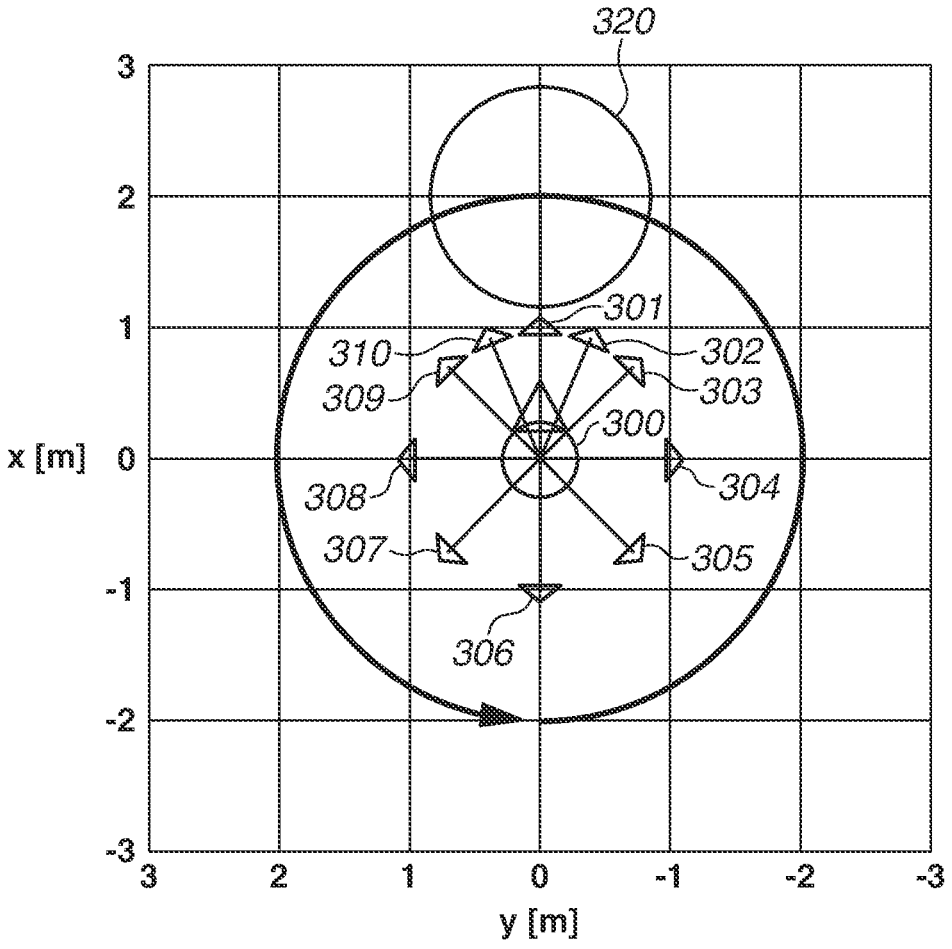
FIG. 3 is a diagram used to explain an arrangement of speakers according to the exemplary embodiment.

FIG. 3 represents information about the arrangement of speakers 120 and the localization of sound, which the signal processing apparatus 100 manages. A reference point 300 represents the position and orientation of the listener 130, and a direction 301 to a direction 310 represent directions of the positions of the respective speakers 120 as viewed from the listener 130. A target range 320 represents a range to which to localize a specific sound that is based on a picked-up sound signal. For example, the signal processing apparatus 100 moves the target range 320 in such a way as to make one counterclockwise revolution from just behind the reference point 300, in other words, from an azimuth angle of −180° to an azimuth angle of 180° in the horizontal plane, thus causing the speakers 120 to reproduce a sound which is heard as if the sound source of a sound targeted for localization revolves around the listener 130.

Figure 4A:
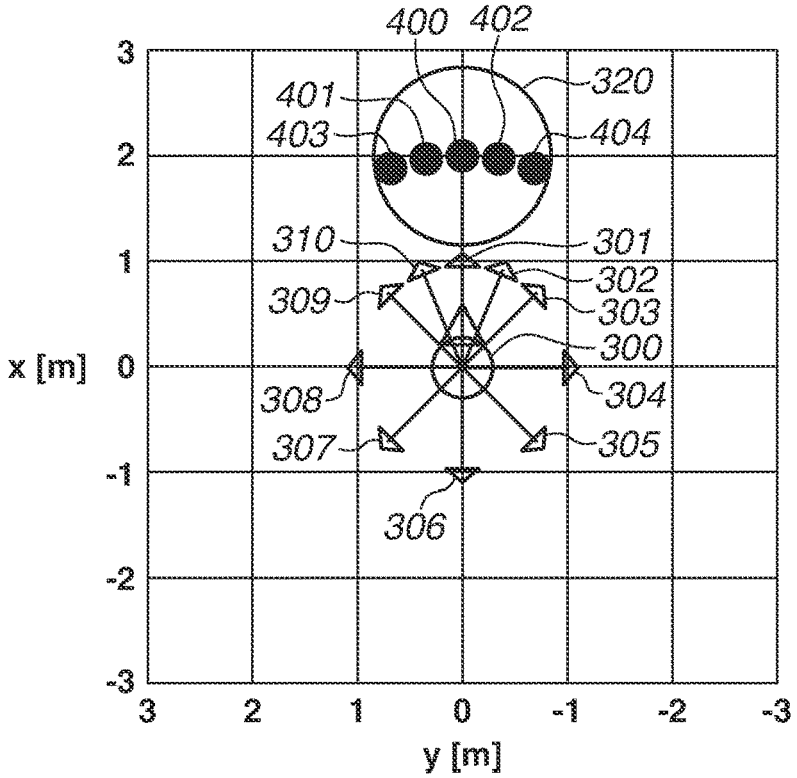
FIGS. 4A and 4B are diagrams used to explain distributed sound sources according to the exemplary embodiment.

Here, for the purpose of expressing the broadening of a sound corresponding to the size of the target range 320, as illustrated in FIG. 4A, setting a plurality of virtual sound sources (i.e., sound sources set on a virtual space so as to determine parameters of signal processing in such a manner that the sound is localized to the target range, and, hereinafter referred to as "distributed sound sources") inside the target range 320 is discussed. Specifically, a distributed sound source 400 is set in the same direction as that of the center of the target range 320 with respect to the reference point 300, and a distributed sound source 401 to a distributed sound source 404 are isotropically set inside the target range 320. In this way, the signal processing apparatus 100 sets a plurality of distributed sound sources and generates a reproducing signal by performing signal processing while assuming that a sound targeted for localization is emitted from each distributed sound source, so that a sound the broadening of which can be felt can be reproduced from the speakers 120. Specifically, the signal processing apparatus 100 sums up and normalizes panning gains obtained by performing vector base amplitude panning (VBAP) processing on the respective distributed sound sources, thus determining panning gains corresponding to the respective speakers 120. This processing is called "multiple-direction amplitude panning (MDAP)".

The panning gain in the present exemplary embodiment is a parameter corresponding to the magnitude of a sound that is reproduced from each speaker 120 to localize the sound in a desired direction. For example, a case where respective panning gains for a specific audio signal are allocated to the speaker 120-1 and the speaker 120-2 and the panning gain of the speaker 120-1 is larger than the panning gain of the speaker 120-2 is discussed. In this case, at the speaker 120-1, a specific audio signal corresponding thereto is reproduced with a sound volume larger than that of a specific audio signal which is reproduced at the speaker 120-2. As a result, the listener 130 perceives that a sound corresponding to the specific audio signal is heard from a direction closer to the speaker 120-1 than the speaker 120-2.

In the example illustrated in FIG. 4A, the distributed sound source 400 to the distributed sound source 404 are isotropically distributed while centering on the direction of the target range 320. Therefore, the direction of a resultant vector p of speaker direction vectors $s_i$ (representing the localization direction of a sound to be reproduced) with panning gains $g_i$ of the respective speakers 120 set as coefficients of linear combination, expressed by the following formula (1), coincides with a vector t representing the central direction of the target range 320. In formula (1), S denotes the number of speakers, and, in the example illustrated in FIG. 4A, S is equal to 10.

$$p = \sum_{i=1}^{s} g_i s_i \tag{1}$$

Figure 5A:
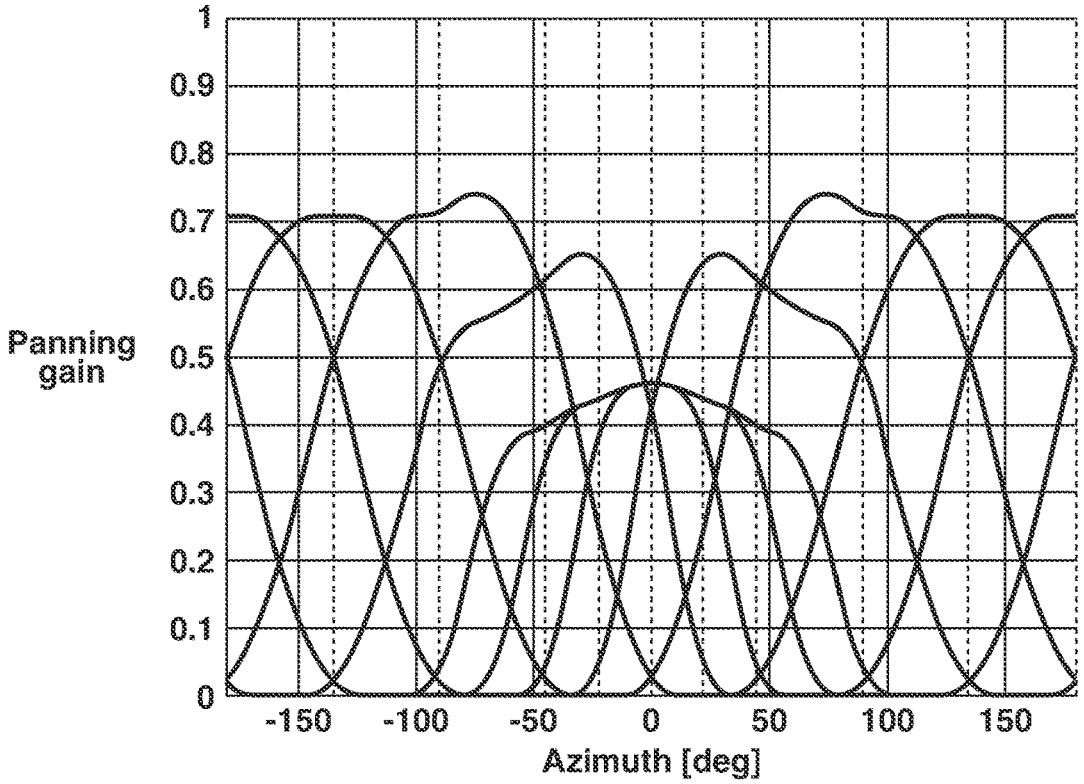
FIGS. 5A and 5B are diagrams used to explain panning curves according to the exemplary embodiment.

In a case where the distributed sound sources are set in such a manner as illustrated in FIG. 4A, the transitions of panning gains of the respective speakers obtained when the target range 320 is caused to make one revolution (panning curves) become those illustrated in FIG. 5A. In the respective directions of −180° to 180°, while just the direction of the resultant vector p coincides with the vector t representing the central direction of the target range 320, there appear unnatural and distorted panning curves, which become maximum in directions deviating from the directions of the respective speakers indicated by vertical dashed lines. This is considered to be because a plurality of speakers 120 is not isotropically arranged and the difference in arrangement direction between adjacent speakers 120 differs with the speakers 120 (for example, a large number of speakers 120 are arranged in front of the listener 130 and a small number of speakers 120 are arranged behind the listener 130).

Figure 4B:
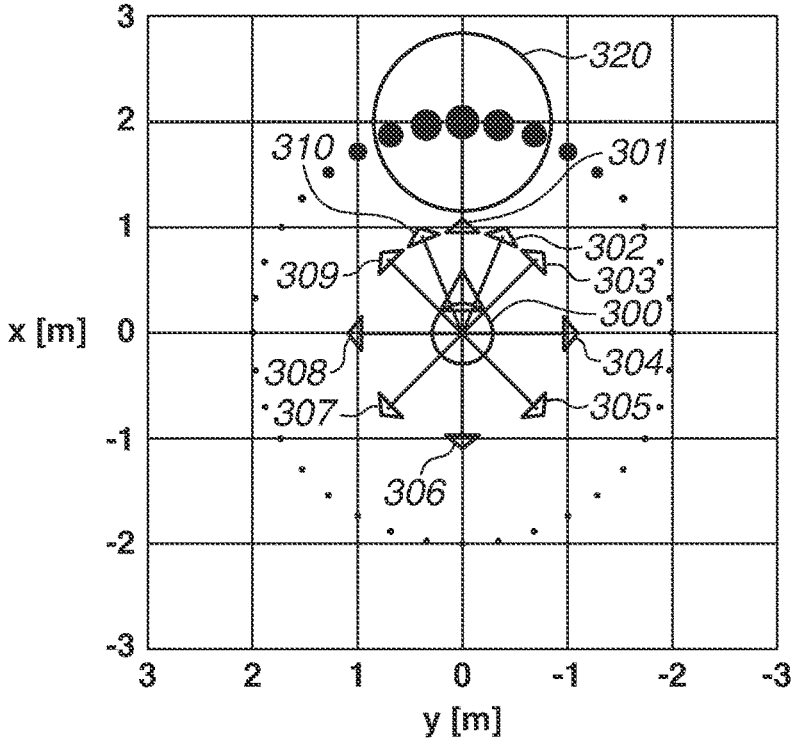
Figure 5B:
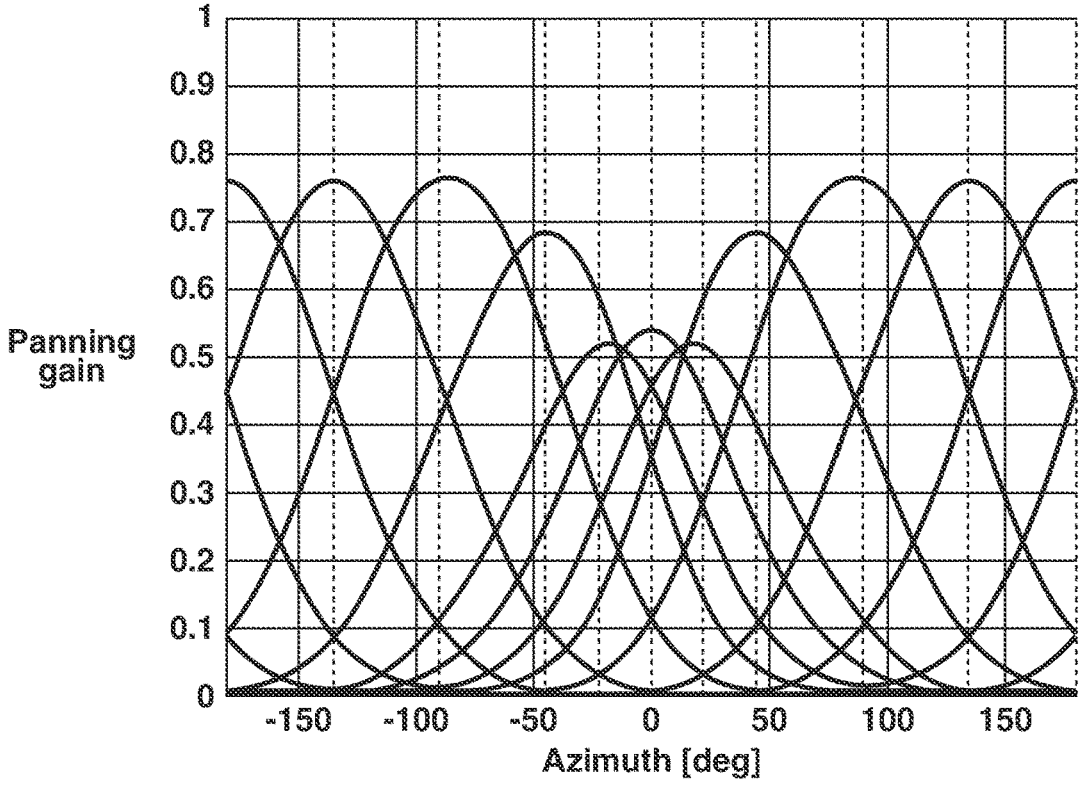

Therefore, as illustrated in FIG. 4B, setting D distributed sound sources, in which the weighting coefficients thereof are made smaller as the angles formed with the central direction of the target range 320 (the differences in direction) are larger, is considered. The size of each distributed sound source illustrated in FIG. 4B represents a weighting coefficient of each distributed sound source. The weighting coefficient of each distributed sound source is set according to, for example, a Gaussian function with σ set as a parameter. In FIG. 4B, the distributed sound sources are not set in such a manner as to be limited to within the target range 320 as illustrated in FIG. 4A, but distributed sound sources, the number of which is D, are isotropically set over the entire circumference with respect to the reference point 300. At this time, the panning gain of each speaker 120 is obtained by summing up and normalizing the panning gains obtained by performing VBAP processing on the respective distributed sound sources with respect to all of the distributed sound sources with weighting attached. In other words, the signal processing apparatus 100 generates a reproducing signal by performing signal processing while assuming that sounds targeted for localization are emitted from the respective distributed sound sources with magnitudes of sound corresponding to the respective weighting coefficients. In a case where the distributed sound sources are set in such a manner as illustrated in FIG. 4B, the panning curves obtained when the target range 320 is caused to make one revolution become those illustrated in FIG. 5B. Thus, even if the arrangement of speakers is disproportionate, natural and smooth panning curves, which become maximum near the directions of speakers indicated by the respective vertical dashed lines, can be obtained.

Figure 6A:
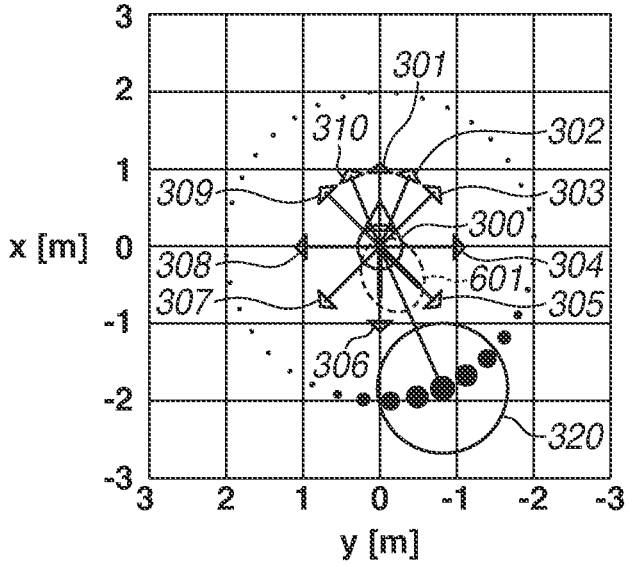
FIGS. 6A, 6B, and 6C are diagrams used to explain the broadening of sound according to the exemplary embodiment.

However, even in a case where setting of the weighted distributed sound sources such as those illustrated in FIG. 4B is performed, with respect to broadening of a sound to be reproduced, there is the following issue caused by the coarseness or denseness of the arrangement of speakers. FIG. 6A illustrates an example in which, when the central direction $\theta_t$ of the target range 320 is −156°, σ of the Gaussian function used to control weighting coefficients of the distributed sound sources is set equal to 20°. Here, the proportion of a thick line in each of the lines representing the respective directions 301 to 310 represents a calculated panning gain of each of speakers arranged in the respective directions. In the case illustrated in FIG. 6A, the panning gain of the speaker 120-5 corresponding to the direction 305 of $\theta_5$=−135° and the panning gain of the speaker 120-6 corresponding to the direction 306 of $\theta_6$=180° are large, and the panning gains of the other speakers 120 are small in value.

Figure 6B:
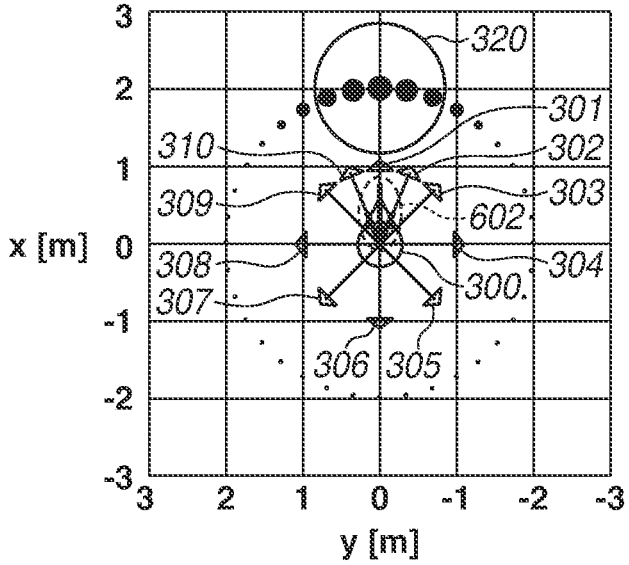

FIG. 6B illustrates an example in which, while 6 of the Gaussian function used to control weighting coefficients of the distributed sound sources remains equal to 20°, the central direction $\theta_t$ of the target range 320 is set equal to 0°. In this case, the panning gain of the speaker 120-1 corresponding to the direction 301 of $\theta_1$=0°, which coincides with $\theta_t$, is the largest. Then, the speaker 120-2 corresponding to the direction 302 of $\theta_2$=−22.5° and the speaker 120-10 corresponding to the direction 310 of $\theta_{10}$=22.5°, which are located on both sides of the speaker 120-1, have certain degrees of panning gains. Then, the panning gains of, for example, the speaker 120-3 corresponding to the direction 303 of $\theta_3=-45°$ and the speaker 120-9 corresponding to the direction 309 of $\theta_9=45°$, which are located on more outer sides, are small.

Here, the difference (open angle) between the direction 305 of the speaker 120-5 and the direction 306 of the speaker 120-6, which have large panning gains in FIG. 6A, is 45°, so that a sound to be localized is considered to have a broadening of sound such as that indicated by a range 601. In FIG. 6B, the open angle between the speaker 120-2 corresponding to the direction 302 and the speaker 120-10 corresponding to the direction 310 is also 450, but, between them, there is a speaker 120-1 corresponding to the direction 301, which has a larger panning gain. Therefore, a sound to be localized is considered to have a broadening of sound such as that indicated by a range 602, and, as compared with the range 601 illustrated in FIG. 6A, the broadening of sound in the case of FIG. 6B is considered to become narrower than that in the case of FIG. 6A.

This issue suggests that, even if, for example, parameters for controlling the state of the distributed sound sources, i.e., the angular range of arrangement of the distributed sound sources or the weighting coefficients thereof, are the same, the broadening of an obtainable sound would change with directions due to the coarseness or denseness of the speaker arrangement. The distributed sound sources are not real sound sources but virtual sound sources which are set and used for calculation to determine the panning gains of the speakers 120 which actually emit sounds. Therefore, even if the distributed sound sources are set according to the target range 320, sounds to be perceived by the listener 130 are sounds from the speakers 120 reproduced based on the calculated panning gains, and the broadening of the sounds is affected by the coarseness or denseness of the speaker arrangement.

Therefore, according to the present exemplary embodiment, the signal processing apparatus 100 acquires information about the arrangement of speakers 120 and sets distributed sound sources based on the arrangement of speakers 120, thus attaining a desired broadening of sounds even if the speaker arrangement is disproportionate. Specifically, the signal processing apparatus 100 estimates the broadening of sound to be reproduced based on the panning gains of speakers 120 and the arrangement of speakers 120. Then, the signal processing apparatus 100 adjusts the parameter $\sigma$ for controlling weighting coefficients of a plurality of isotropically arranged distributed sound sources in such a manner that the estimated broadening of sound coincides with the designated target range 320. In other words, in the present exemplary embodiment, the signal processing apparatus 100 performs processing which might be termed "weight optimization all-direction amplitude panning (ADAP)".

However, the method for setting the distributed sound sources is not limited to this, and, for example, the signal processing apparatus 100 can control weighting coefficients of the distributed sound sources with the inclination of a triangle wave function or the width of a square wave function used as parameters. Moreover, the signal processing apparatus 100 can control the density of arrangement of distributed sound sources with use of these functions, and, specifically, the signal processing apparatus 100 can perform such setting as to decrease the density of arrangement of distributed sound sources (i.e., increase intervals) as the difference in direction from the target range 320 is larger.

Figure 6C:
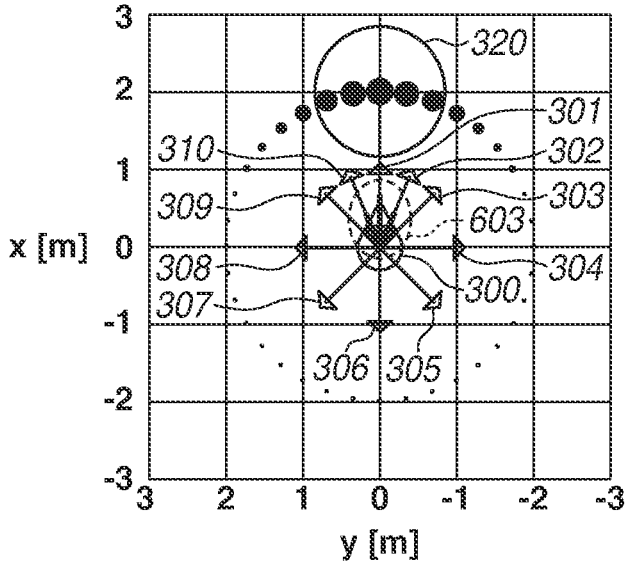

According to the method in the present exemplary embodiment for setting distributed sound sources based on the arrangement of speakers, for example, in a case where a target range 320 similar to that illustrated in FIG. 6B is designated, distributed sound sources which are large in weighting coefficients as illustrated in FIG. 6C are set over a wide range. At this time, the difference in panning gain between the speaker 120-1 in the direction 301 and the speakers 120-2 and 120-10 on both sides of the speaker 120-1 becomes smaller than in the case illustrated in FIG. 6B. Moreover, the panning gains of the speaker 120-3 in the direction 303 and the speaker 120-9 in the direction 309 become larger than in the case illustrated in FIG. 6B. Thus, a concentration in one direction of energy of sounds to be reproduced is prevented, so that the distributed sound sources are dispersed over a wider range. With this, the broadening of sound indicated by the range 603 in the case of FIG. 6C becomes wider than the broadening of sound indicated by the range 602 in the case of FIG. 6B, and thus becomes nearly equal to the broadening of sound indicated by the range 601 in the case of FIG. 6A. In other words, it becomes possible to reproduce sounds which cause feeling of the broadening of sound coinciding with the target range 320 regardless of directions of the target range 320 with respect to the reference point 300.

[Operation Flow]

Figure 2:
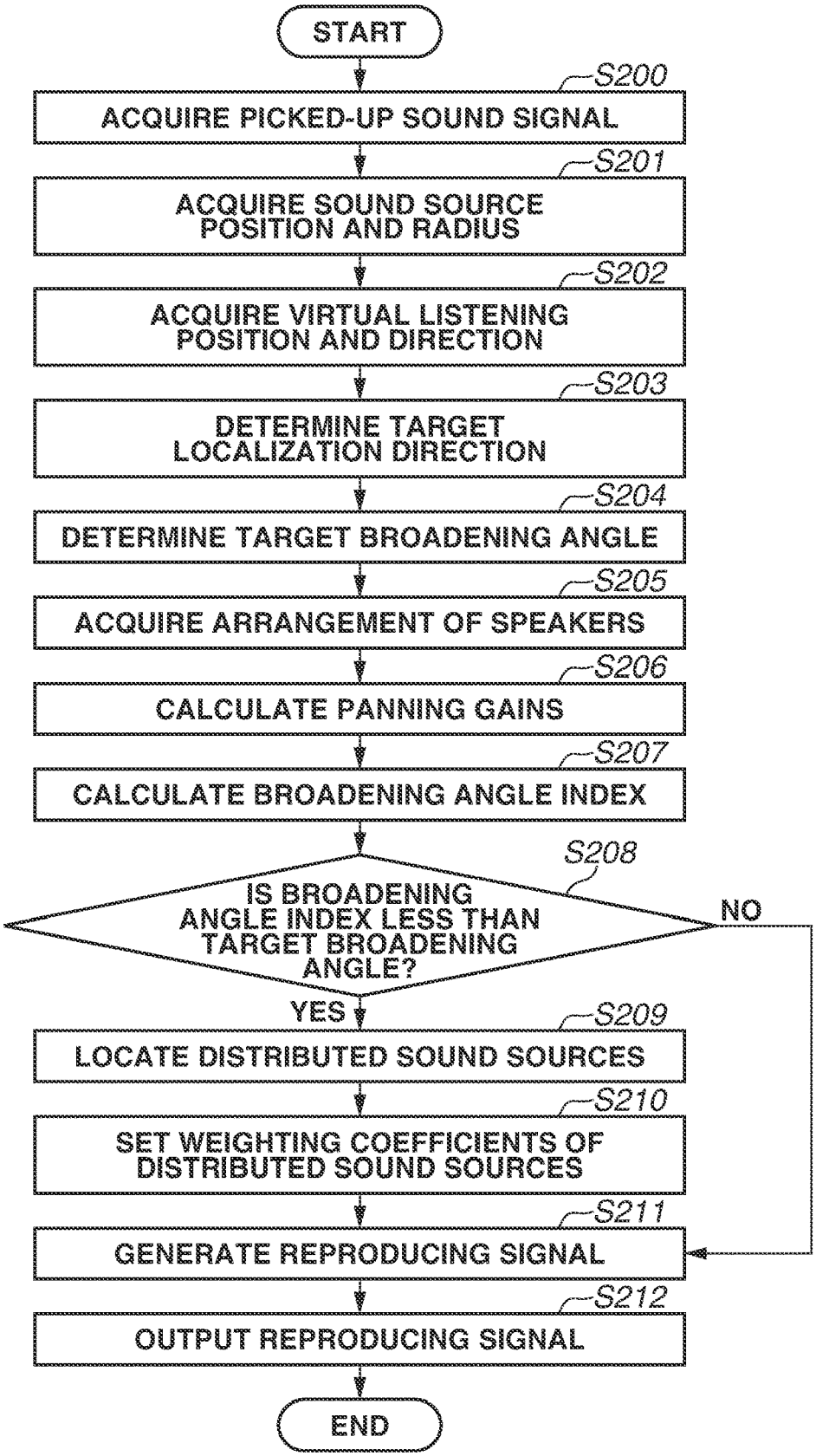
FIG. 2 is a flowchart illustrating an operation of a signal processing apparatus according to the exemplary embodiment.

In the following description, an operation of the signal processing apparatus 100 according to the present exemplary embodiment is described with reference to the flowchart of FIG. 2. The processing illustrated in FIG. 2 is started at timing when a picked-up sound signal is input to the signal processing apparatus 100 and an instruction for generating a reproducing signal is then issued. The instruction for generating a reproducing signal can be issued by a user operation performed via the operation unit 806 of the signal processing apparatus 100 or can be input from another apparatus. Then, the processing illustrated in FIG. 2 is repeatedly performed at intervals of a time block having a predetermined time length. However, the execution timing of the processing illustrated in FIG. 2 is not limited to the above-mentioned timing. The processing illustrated in FIG. 2 can be performed in parallel with sound pickup performed by the microphone 110, or can be performed after sound pickup performed by the microphone 110 ends. The processing illustrated in FIG. 2 can be implemented by the CPU 801 loading a program stored in the ROM 802 onto the RAM 803 and executing the program. At least a part of the processing illustrated in FIG. 2 can be implemented by one or a plurality of pieces of dedicated hardware different from the CPU 801.

In step S200, the input unit 105 receives an input from the microphone 110 to acquire an input audio signal that is based on sound pickup performed by the microphone 110. The input audio signal to be acquired in step S200 is not limited to a picked-up sound signal that is based on sound pickup performed by the microphone 110, but can be an audio signal generated by a computer.

In step S201, the operation detection unit 104 detects an operation input performed via the operation unit 806 and acquires, based on a result of detection, coordinate values representing the position of a specific sound source in a virtual space and a sound source radius r indicating the size of the specific sound source. The specific sound source is a sound source that emits a sound corresponding to a picked-up sound signal. For example, in a case where the picked-up sound signal acquired in step S200 is a signal obtained by picking up, for example, cheers in spectator stands of the athletic field with the microphone 110, information corresponding to the size and position of a spectator group serving as a specific sound source is acquired. The coordinate values acquired in step S201 is expressed by, for example, a world coordinate system corresponding to a virtual space.

In step S202, the operation detection unit 104 detects an operation input performed via the operation unit 806 and acquires, based on a result of detection, a virtual listening position and a virtual listening direction representing the position and direction of a listener in a virtual space. In step S203, the signal processing unit 102 converts the coordinate values representing the position of a sound source in a virtual space acquired in step S201 into coordinate values in a coordinate system in which the virtual listening position and the virtual listening direction acquired in step S202 are set as the origin and the reference direction, respectively. This coordinate system can be considered to be a coordinate system that is based on the head of a listener who faces in the virtual listening direction at the virtual listening position, and, hereinafter, this coordinate system is referred to as a "head coordinate system". This results in determining a target localization direction representing a central direction of the target range 320 to which to localize a sound corresponding to a picked-up sound signal.

In step S204, the signal processing unit 102 determines a target broadening angle $\varphi_t$ representing the size of the target range 320 based on the distance from the virtual listening position in a virtual space to the position of a specific sound source and the size of the specific sound source. The target broadening angle $\varphi_t$ is calculated as in the following formula (2), where the sound source diameter acquired in step S201 is denoted by r and the distance to the sound source position in the head coordinate system calculated in step S203 is denoted by d.

$$\varphi_t = 2\arctan\left(\frac{r}{d}\right) \tag{2}$$

As indicated in formula (2), the target broadening angle $\varphi_t$ becomes 90° when the virtual listening position has come close to a position corresponding to the sound source radius and becomes 180° when the virtual listening position has reached the sound source center. The method for calculating the target broadening angle $\varphi_t$ is not limited to this, and, for example, an angle formed by two tangent lines drawn from the virtual listening position to a circle having the sound source radius can be set as the target broadening angle $\varphi_t$, so that, in this case, when the virtual listening position comes close to a position corresponding to the sound source radius, the target broadening angle (Pt becomes 180°.

As described above, in steps S203 and S204, the signal processing unit 102 determines the target range 320 to which to localize a sound corresponding to a picked-up sound signal in reproduction of a reproducing signal, and acquires information indicating the determined target range 320. Specifically, the signal processing unit 102 determines the target range 320 based on an operation for designating a virtual listening position and a virtual listening direction in a space. Performing processing described below to generate and reproduce a reproducing signal corresponding to the target range 320 determined in the above-described manner enables the listener 130 to feel as if listening to a sound emitted from a specific sound source corresponding to a picked-up sound signal at the designated position and in the designated direction. For example, a listener 130 who listens to a sound reproduced by the speakers 120, when designating an optional position in the athletic field, can listen to, for example, cheers of spectators obtained by reproducing the direction and broadening of a sound that would be able to be heard at that position.

The method for determining the target range 320 is not limited to the above-described method. For example, the virtual listening position, the virtual listening direction, or both can be automatically determined. While the virtual listening position and the virtual listening direction are fixed, the signal processing unit 102 can determine the target range 320 based on only a user operation for designating the position and size of a specific sound source. The display control unit 103 can cause the display unit 805 to display an image such as that illustrated in FIG. 3, the operation detection unit 104 can detect a user operation performed on the displayed image, and the signal processing unit 102 can determine the target range 320 based on a result of the detection.

The signal processing apparatus 100 can specify a positional relationship between the microphone 110 and a specific sound source using, for example, placement information about the microphone 110 and a captured image including at least a part of a sound pickup target area, thus determining the target range 320. The signal processing apparatus 100 can acquire identification information about the microphone 110 and information indicating the type thereof as information about characteristics (for example, directional characteristics) of sound pickup performed by the microphone 110, and can determine the target range 320 using such information. For example, in a case where a picked-up sound signal obtained by a narrow directional microphone 110 such as a shotgun microphone is input, the size of the target range 320 can be set small, and, in a case where a picked-up sound signal obtained by a wide directional or non-directional microphone 110 is input, the size of the target range 320 can be set large. These methods enable reducing the user's trouble of determining the target range 320. The signal processing apparatus 100 can acquire information indicating the target range 320 from another apparatus. In a case where there is no designation of the target range 320, the signal processing apparatus 100 can use parameters that are set by default with respect to the target range 320.

While, in the present exemplary embodiment, a case where information representing a direction corresponding to the target range 320 (the central direction and the broadening angle) is determined by the signal processing unit 102 is described, the manner of representing the target range 320 is not limited to this. For example, the signal processing apparatus 100 can determine information representing an area corresponding to the target range 320 in a coordinate system that is based on the virtual listening position and the virtual listening direction (for example, vertex coordinates of the area), and can perform processing described below with use of such information.

In step S205, the operation detection unit 104 detects an operation input performed via the operation unit 806, and performs, based on a result of detection, information acquisition to acquire information about the arrangement of a plurality of speakers 120 related to reproduction of a reproducing signal. Specifically, the operation detection unit 104 acquires speaker direction vectors $s_i$ (i=1 to S) corresponding to the respective speakers 120 such as those indicated by the direction 301 to the direction 310 illustrated in FIG. 3. The arrangement of speakers 120 can be configured to be optionally designated by the user, or can be configured to be selected by the user from among predetermined arrangements such as 5.1 channel arrangement and 22.2 channel arrangement.

In the present exemplary embodiment, the speakers 120 in a reproduction environment (listening room) are arranged centering on the listener 130 as illustrated in FIG. 1, and information about the arrangement of the speakers 120 is represented by a direction in the head coordinate system as with the target localization direction. However, the form of information about the arrangement of the speakers 120 is not limited to this, but can be, for example, the form of coordinate values representing the position of each speaker 120. The information about the arrangement of the speakers 120 does not need to be information directly indicating the arrangement of the speakers 120, but can be, for example, identification information corresponding to any one of a predetermined plurality of patterns of speaker arrangements.

The method for acquiring information about the arrangement of the speakers 120 is not limited to the above-described method. For example, information indicating the arrangement of the speakers 120 can be acquired by estimation that is based on, for example, the number of speakers 120 connected to the signal processing apparatus 100. For example, information indicating the arrangement of the speakers 120 can be acquired based on a result obtained by picking up a sound reproduced by the speakers 120. The processing in step S205 does not need to be performed each time at intervals of a time block, but only needs to be performed in a case where the processing flow illustrated in FIG. 2 is performed for the first time or in a case where the arrangement of speakers has been changed.

In step S206, the signal processing unit 102 calculates the panning gains of the respective speakers 120, which are used to localize a sound corresponding to a picked-up sound signal to the target localization direction calculated in step S203, during reproduction in the arrangement of speakers 120 indicated by the information acquired in step S205. In step S206, the signal processing unit 102 calculates the panning gains, without performing setting of a plurality of distributed sound sources such as those illustrated in FIGS. 6A to 6C, assuming that there is a single sound source in the target localization direction. These panning gains can be calculated by known vector base amplitude panning (VBAP) processing, so that the panning gains $g_i$ (i=1 to S) of the respective speakers 120 are obtained.

In step S207, the signal processing unit 102 calculates a broadening angle index $\varphi_e$ using the speaker direction vectors $s_i$ (i=1 to S) acquired in step S205 and the panning gains $g_i$ (i=1 to S) calculated in step S206. The broadening angle index $\varphi_e$ represents a degree of broadening of sound in a case where reproduction with the speakers 120 is performed according to the calculated panning gains. While the method for calculating the broadening angle index $\varphi_e$ is not limited, in a case where panning gains are allocated to only two adjacent speakers and the panning gains are the same value, the broadening angle index $\varphi_e$ is determined in such a manner as to become a value corresponding to a difference in direction between those two speakers. Unless the target localization direction completely coincides with the direction of any speaker 120, since panning gains are allocated to a plurality of speakers 120, the broadening angle index $\varphi_e$ becomes larger than zero ($\varphi_e>0$).

In step S208, the signal processing unit 102 determines whether the broadening angle index $\varphi_e$ calculated in step S207 is less than the target broadening angle $\varphi_t$ calculated in step S204, i.e., $\varphi_e<\varphi_t$. If it is determined that $\varphi_e<\varphi_t$ (YES in step S208), the processing proceeds to step S209 to set a plurality of distributed sound sources so as to increase the degree of broadening of sound. If it is determined that the broadening angle index $\varphi_e$ is greater than or equal to the target broadening angle $\varphi_t$, i.e., $\varphi_e\geq\varphi_t$ (NO in step S208), since it is not necessary to increase the degree of broadening of sound, the processing proceeds to step S211 to generate a reproducing signal without performing setting of a plurality of distributed sound sources. In other words, in step S208, the signal processing unit 102 determines whether to set a plurality of distributed sound sources in generating a reproducing signal. In this way, in a case where a sufficient broadening of sound is able to be obtained without having to perform setting of a plurality of distributed sound sources, generating a reproducing signal without performing setting of a plurality of distributed sound sources enables preventing or reducing the degree of broadening of sound from becoming too larger than the target broadening angle. However, the signal processing apparatus 100 can advance the processing to step S209 irrespective of the magnitude relationship of the broadening angle index $\varphi_e$ without performing determination in step S208.

In step S209, the signal processing unit 102 locates a plurality of distributed sound sources, which corresponds to respective different directions, on the entire circumference centering on the reference point corresponding to the virtual listening position. In other words, a plurality of distributed sound sources that is set by the signal processing unit 102 is distributed in an isotropic manner. For example, D=36 distributed sound sources are located at intervals of an azimuth angle of 10° with respect to the entire circumference of 360° of the horizontal plane. Instead of setting of an angle indicating the direction of each distributed sound source or in addition to that setting, coordinates indicating the position of each distributed sound source can be set. In step S210, the signal processing unit 102 sets weighting coefficients respectively corresponding to the located plurality of distributed sound sources. As described above, in the present exemplary embodiment, the weighting coefficients are determined based on the Gaussian function using $\sigma$ as the parameter. Specifically, as an angle between the target localization direction corresponding to the center of the target range 320 and the direction corresponding to a distributed sound source is larger, the weighting coefficient of the distributed sound source is determined to be a smaller value. The distributed sound sources set in steps S209 and S210 become, for example, as illustrated in FIG. 6C.

If the distributed sound sources are set only within the target range 320 as illustrated in FIG. 4A, in a case where there is no difference or a small difference in weighting coefficient between a plurality of distributed sound sources, distorted panning curves such as those illustrated in FIG. 5A would appear. Moreover, in a case where there is a large difference in weighting coefficient between a plurality of distributed sound sources, although panning curves themselves become smooth and regular, since a distributed sound source which is large in weighting coefficient becomes dominant within a limited angular range, it can be considered that only a broadening of sound narrower than the desired target broadening angle $\varphi_t$ can be attained. In the present exemplary embodiment, a plurality of distributed sound sources is distributed in an isotropic manner not only within the target range 320 and weighting coefficients of the respective distributed sound sources are set according to the target range 320, so that a broadening of sound consistent with the desired target broadening angle (Pt can be attained.

In the present exemplary embodiment, information about the arrangement of a plurality of speakers 120 is used in determining weighting coefficients of the distributed sound sources in step S210. More specifically, the signal processing unit 102 sets a plurality of distributed sound sources corresponding to a picked-up sound signal based on the arrangement of a plurality of speakers 120 indicated by the information acquired in step S205 and the target range 320 determined in steps S203 and S204. As a result, the setting of a plurality of distributed sound sources becomes a setting corresponding to the arrangement of a plurality of speakers 120. Specifically, the signal processing unit 102 calculates panning gains $g_i$ (i=1 to S) of the respective speakers in the case of setting the weighting coefficients of the distributed sound sources to predetermined values, and calculates the broadening angle index $\varphi_e$ in the case of setting the distributed sound sources with use of the speaker direction vectors $s_i$ (i=1 to S) of the respective speakers. Then, the signal processing unit 102 updates the weighting coefficients by adjusting, for example, the parameter $\sigma$ of the Gaussian function in such a manner that a difference between the calculated broadening angle index $\varphi_e$ and the target broadening angle $\varphi_t$ determined in step S204 becomes less than or equal to a threshold value.

If a plurality of distributed sound sources is set in the above-described manner, in a case where the arrangement of a plurality of speakers 120 is not isotropic, even when the size of the target range 320 is fixed, the number of distributed sound sources to which weighting coefficients greater than or equal to a predetermined value are set differs according to the direction of the target range 320. For example, between the case illustrated in FIG. 6A and the case illustrated in FIG. 6C, while the size of the target range 320 is the same, the direction of the target range 320 differs, so that the distributed sound sources to which weighting coefficients greater than or equal to a predetermined value are set are spreading over a wider range in the case illustrated in FIG. 6C. However, since such an arrangement that the number of speakers 120 situated in front of the listener 130 is large and the number of speakers 120 situated behind the listener 130 is small is set, the listener 130 can feel as if the broadening of sound is the same and the direction of sound is different between the case illustrated in FIG. 6A and the case illustrated in FIG. 6C.

The method for setting a plurality of distributed sound sources is not limited to the above-described method, and another setting method can be employed as long as a plurality of distributed sound sources is set based on information about the arrangement of speakers 120 and the target range 320. For example, a distributed sound source having a small weighting coefficient can be located between two distributed sound sources having large weighting coefficients. The density of arrangement of a plurality of distributed sound sources can differ depending on directions. A plurality of distributed sound sources can be set only within a predetermined range centering on the target localization direction (for example, a semiperimeter).

In a case where distributed sound sources have been set in steps S209 and S210, for example, the display control unit 103 can cause the display unit 805 to display an image indicating a plurality of distributed sound sources set as illustrated in FIG. 6C. This enables the user who operates the signal processing apparatus 100 to check how the distributed sound sources are set, thus enabling reducing the possibility of an unintended reproducing signal being generated. Additionally, the operation detection unit 104 can detect an operation performed by the user on the displayed image, and the signal processing unit 102 can change setting of the distributed sound sources based on a result of the detection. In other words, the signal processing apparatus 100 can change setting of a plurality of distributed sound sources based on an operation performed by the user. The display control unit 103 can cause the display unit 805 to display panning curves such as those illustrated in FIG. 5B.

In a case where a plurality of distributed sound sources has been set, in step S211, the signal processing unit 102 generates a reproducing signal by processing the picked-up sound signal acquired in step S200 based on setting of a plurality of distributed sound sources performed in steps S209 and S210. Specifically, the signal processing unit 102 generates a reproducing signal by processing the picked-up sound signal using parameters determined based on the positions or directions of the set plurality of distributed sound sources and the arrangement of a plurality of speakers 120 indicated by the information acquired in step S205. The reproducing signal to be generated here is a reproducing signal having a plurality of channels corresponding to a plurality of speakers 120. The above-mentioned parameters are, for example, panning gains $g_i$ (i=1 to S) corresponding to the magnitude of a sound that is based on a picked-up sound signal to be reproduced by the respective speakers 120.

The method for generating a reproducing signal based on setting of distributed sound sources is not limited to the above-mentioned method. In a case where a plurality of speakers 120 is not located at an equal distance from the listener 130, level correction or delay correction for each speaker 120 can be performed on the reproducing signal. Level correction or delay correction can be performed on the reproducing signal based on a distance d between the position of a specific sound source in a virtual space and the virtual listening position, which is calculated in step S203.

If, in step S208, it is determined that the broadening angle index $\varphi_e$ is greater than or equal to the target broadening angle $\varphi_t$ (NO in step S208), i.e., if it is determined not to set a plurality of distributed sound sources, then in step S211, the signal processing unit 102 generates a reproducing signal without using setting of distributed sound sources. Specifically, the signal processing unit 102 generates a reproducing signal having a plurality of channels by processing the picked-up sound signal using parameters determined based on the position or direction of the center of the target range 320 and the arrangement of a plurality of speakers 120 indicated by the information acquired in step S205.

The reproducing signal generated in step S211 is successively stored by the storage unit 101. Then, in step S212, the output unit 106 outputs the reproducing signal stored in the storage unit 101 to a plurality of speakers 120. Such an output sound being reproduced by a plurality of speakers 120 causes a sound corresponding to the picked-up sound signal to localize in the directions and the degree of broadening of sound corresponding to the target range 320. For example, in a case where speakers 120 serving as an output destination of a reproducing signal are mounted on headphones or earphones to be worn on the listener 130, the output unit 106 can output a signal obtained by applying a head-related transfer function (HRTF) corresponding to each speaker 120 to the reproducing signal.

The description up to this point has been of FIG. 2. The above description has described a case where the signal processing apparatus 100 acquires a picked-up sound signal corresponding to one sound source and then generates a reproducing signal corresponding to the picked-up sound signal. However, the signal processing apparatus 100 can acquire a picked-up sound signal having a plurality of channels corresponding to a plurality of sound sources and then generate a reproducing signal having a plurality of channels corresponding to the picked-up sound signal having a plurality of channels. In this case, the processing in steps S201 to S210 is performed for each channel of the picked-up sound signal. Then, in generating a reproducing signal in step S211, reproducing signals generated for the respective channels of the picked-up sound signal are combined, so that a final reproducing signal to be output to the speakers 120 is generated. The signal processing apparatus 100 can perform the localization processing described with reference to FIG. 2 on a picked-up sound signal of some channels of the acquired picked-up sound signal of a plurality of channels and not perform the localization processing on a picked-up sound signal of the other channels, then generating a reproducing signal by combining such picked-up sound signals.

Figure 7:
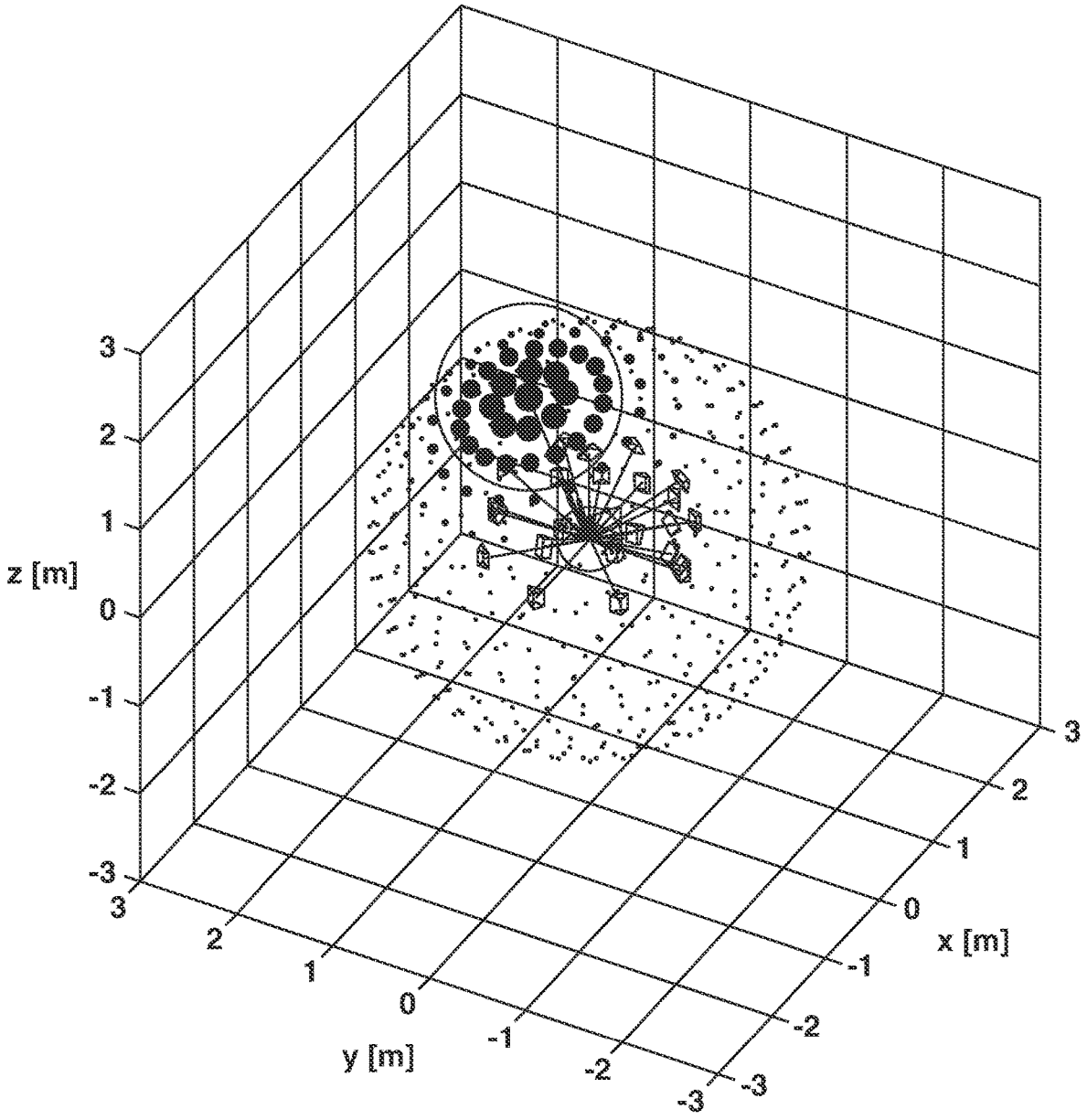
FIG. 7 is a diagram used to explain a three-dimensional arrangement of distributed sound sources according to the exemplary embodiment.

While, in the above description, for ease of comprehension, a case where the arrangement of speakers 120 and the arrangement of distributed sound sources are two-dimensional has been described, the present exemplary embodiment can also be applied to a case where the arrangement of speakers 120 is three-dimensional. In this instance, locating the distributed sound sources in step S209 is performed, for example, in the following way. First, 36 distributed sound sources are provided at intervals of an azimuth angle of 10° over the entire circumference 360° of the horizontal plane. Next, an azimuth angle interval of distributed sound sources in each elevation angle is determined such that, when the circular arc length L between adjacent distributed sound sources in the horizontal plane is used as a reference, the circular arc length between adjacent distributed sound sources in each of elevation angles taken at intervals of 10° becomes less than or equal to the circular arc length L. With respect to D=450 distributed sound sources located in this way, weighting coefficients are set in step S210. FIG. 7 illustrates an example of setting of distributed sound sources in a case where the present exemplary embodiment is applied to a three-dimensional speaker arrangement of 22.2 channels.

As described above, the signal processing apparatus 100 according to the present exemplary embodiment generates a reproducing signal from an input audio signal. Specifically, the signal processing apparatus 100 acquires information about the arrangement of a plurality of speakers 120 concerning reproduction of a sound that is based on a reproducing signal, and sets a plurality of virtual sound sources corresponding to an input audio signal. In this setting, the signal processing apparatus 100 sets a plurality of virtual sound sources based on information about the arrangement of a plurality of speakers 120 in such a manner that the setting of the plurality of virtual sound sources corresponds to the arrangement of a plurality of speakers 120. Then, the signal processing apparatus 100 generates a reproducing signal by processing an input audio signal based on setting of a plurality of virtual sound sources. According to such a configuration, even in a case where the arrangement of a plurality of speakers 120 is not isotropic, an audio signal for attaining a desired broadening of sound can be generated.

The signal processing apparatus 100 can store panning gains of the respective speakers 120 corresponding to the directions and sizes of the target range 320 in the form of, for example, a look-up table. More specifically, the signal processing apparatus 100 can previously store association information in which the target range 320 and the magnitude of a sound reproduced from each of a plurality of speakers 120 are associated with each other. Then, the signal processing apparatus 100 can receive setting of the target range 320 and then generate a reproducing signal having a plurality of channels corresponding to a plurality of speakers 120 by processing an input audio signal based on the setting of the target range 320 and the previously-stored association information. In this case, the signal processing apparatus 100 can calculate values that are not registered in a table serving as the above-mentioned association information, by using, for example, linear interpolation. According to such a method, the amount of throughput of the signal processing apparatus 100 can be decreased as compared with a case where, each time the target range 320 changes, virtual sound sources are set again and panning gains are recalculated.

Appropriate panning gains corresponding to the target range 320 differ depending on the arrangement of a plurality of speakers 120. Therefore, the signal processing apparatus 100 can store the above-mentioned association information for each pattern of the arrangement of a plurality of speakers 120 (for example, separately for a pattern for a 5.1 channel system and for a pattern for a 22.2 channel system). In this case, the signal processing apparatus 100 acquires information about the arrangement of speakers 120 and then generates a reproducing signal based on the acquired information about the arrangement of speakers 120, the received setting of the target range 320, and the above-mentioned stored association information. With this, even in a case where the arrangement of speakers 120 is able to take a plurality of patterns, an audio signal for attaining a desired broadening of sound can be generated.

According to the above-described exemplary embodiment, it becomes possible to appropriately control a broadening of sound which is perceived by the listener when a sound is reproduced with use of speakers.

Other Embodiments

Embodiment(s) can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While exemplary embodiments have been described, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-015118 filed Jan. 31, 2018, which is hereby incorporated by reference herein in its entirety.

What is claimed is:

1. A signal processing apparatus configured to generate a reproducing audio signal from an input audio signal, the signal processing apparatus comprising:

one or more hardware processors; and one or more memories which store instructions executable by the one or more hardware processors to cause the signal processing apparatus to perform at least:

acquiring information indicating an arrangement of a plurality of speakers used for reproduction of a sound that is based on the reproducing audio signal;

specifying a target range for localization of a sound corresponding to the input audio signal;

setting, based on the arrangement of the plurality of speakers indicated by the acquired information, weighting coefficients corresponding respectively to a plurality of virtual sound sources for localization of a sound broadening in the specified target range; and generating a plurality of channels of the reproducing audio signal corresponding respectively to the plurality of speakers by processing the input audio signal based on positions of the plurality of virtual sound sources, the set weighting coefficients, and the arrangement of the plurality of speakers, wherein, in a case where the arrangement of the plurality of speakers is not isotropic, a number of virtual sound sources to which weighting coefficients greater than or equal to a predetermined value are set differs depending on a direction corresponding to the specified target range even if a size of the specified target range is fixed.

2. The signal processing apparatus according to claim 1, wherein the input audio signal is an audio signal acquired based on sound pickup performed by a microphone.

3. The signal processing apparatus according to claim 2, wherein the input audio signal is an audio signal corresponding to a sound emitted from a plurality of sound sources located in a predetermined area in which sound pickup is performed by the microphone.

4. The signal processing apparatus according to claim 1, wherein the plurality of channels of the reproducing audio signal corresponding respectively to the plurality of speakers is generated by processing the input audio signal using a parameter that is determined based on the plurality of virtual sound sources and the arrangement of the plurality of speakers.

5. The signal processing apparatus according to claim 1, wherein the plurality of virtual sound sources is distributed in an isotropic manner.

6. The signal processing apparatus according to claim 1, wherein, as an angle formed between a direction corresponding to a center of the specified target range and a direction corresponding to a virtual sound source is larger, a weighting coefficient of the virtual sound source is set to a smaller value.

7. The signal processing apparatus according to claim 1, wherein the target range is specified based on at least one of information representing a direction corresponding to the target range or information representing an area corresponding to the target range.

8. The signal processing apparatus according to claim 1, wherein the target range is specified based on information according to an operation performed by a user.

9. The signal processing apparatus according to claim 8, wherein the operation performed by the user is an operation for designating a virtual listening position or a virtual listening direction in a space.

10. The signal processing apparatus according to claim 1, wherein the target range is specified based on at least one of information indicating a location of a microphone for acquiring the input audio signal, a captured image including at least a part of a predetermined area in which sound pickup is performed by the microphone, or information about a characteristic of sound pickup performed by the microphone.

11. The signal processing apparatus according to claim 1, wherein the instructions further cause the signal processing apparatus to perform determining whether to use a plurality of virtual sound sources, wherein, if it is determined not to use the plurality of virtual sound sources, the plurality of channels of the reproducing audio signal is generated by processing the input audio signal based on a position of a center of the specified target range and the arrangement of the plurality of speakers indicated by the acquired information.

12. The signal processing apparatus according to claim 1, wherein the instructions further cause the signal processing apparatus to perform controlling a display unit to display an image indicating the plurality of virtual sound sources.

13. A signal processing method for generating a reproducing audio signal from an input audio signal, the signal processing method comprising:

acquiring information indicating an arrangement of a plurality of speakers used for reproduction of a sound that is based on the reproducing audio signal;

specifying a target range for localization of a sound corresponding to the input audio signal;

setting, based on the arrangement of the plurality of speakers indicated by the acquired information, weighting coefficients corresponding respectively to a plurality of virtual sound sources for localization of a sound broadening in the specified target range; and generating a plurality of channels of the reproducing audio signal corresponding respectively to the plurality of speakers by processing the input audio signal based on positions of the plurality of virtual sound sources, the set weighting coefficients, and the arrangement of the plurality of speakers, wherein, in a case where the arrangement of the plurality of speakers is not isotropic, a number of virtual sound sources to which weighting coefficients greater than or equal to a predetermined value are set differs depending on a direction corresponding to the specified target range even if a size of the specified target range is fixed.

14. The signal processing method according to claim 13, wherein the input audio signal is an audio signal acquired based on sound pickup performed by a microphone, and wherein the input audio signal corresponds to a sound emitted from a plurality of sound sources located in a predetermined area in which sound pickup is performed by the microphone.

15. The signal processing method according to claim 13, wherein the plurality of virtual sound sources is distributed in an isotropic manner.

16. A non-transitory computer readable storage medium storing computer-executable instructions that, when executed by a computer, cause the computer to perform an information processing method for generating a reproducing audio signal from an input audio signal, the information processing method comprising:

acquiring information indicating an arrangement of a plurality of speakers used for reproduction of a sound that is based on the reproducing audio signal;

specifying a target range for localization of a sound corresponding to the input audio signal;

setting based on the arrangement of the plurality of speakers indicated by the acquired information, weighting coefficients corresponding respectively to a plurality of virtual sound sources for localization of a sound broadening in the specified target range; and generating a plurality of channels of the reproducing audio signal corresponding respectively to the plurality of speakers by processing the input audio signal based on the positions of the plurality of virtual sound sources, the set weighting coefficients, and the arrangement of the plurality of speakers, wherein, in a case where the arrangement of the plurality of speakers is not isotropic, a number of virtual sound sources to which weighting coefficients greater than or equal to a predetermined value are set differs depending on a direction corresponding to the specified target range even if a size of the specified target range is fixed.

* * * * *